US011306490B1

(12) United States Patent
Blow et al.

(10) Patent No.: US 11,306,490 B1
(45) Date of Patent: Apr. 19, 2022

(54) ROOFING SAFETY SYSTEM

(71) Applicants: Johnny Blow, Wake Forest, NC (US); Sonya Blow, Wake Forest, NC (US)

(72) Inventors: Johnny Blow, Wake Forest, NC (US); Sonya Blow, Wake Forest, NC (US)

( * ) Notice: Subject to any disclaimer, the term of this patent is extended or adjusted under 35 U.S.C. 154(b) by 106 days.

(21) Appl. No.: 16/835,443

(22) Filed: Mar. 31, 2020

(51) Int. Cl.

| | |
|---|---|
| ***E04G 3/26*** | (2006.01) |
| ***A62B 35/00*** | (2006.01) |
| ***E04G 21/32*** | (2006.01) |
| ***E04D 15/00*** | (2006.01) |

(52) U.S. Cl.
CPC ..... *E04G 3/265* (2013.01); *A62B 35/0068* (2013.01); *E04D 15/00* (2013.01); *E04G 3/26* (2013.01); *E04G 21/3276* (2013.01)

(58) Field of Classification Search
CPC ..... E04G 3/26; E04G 3/265; E04G 5/041; A62B 35/0043; A62B 35/0068; E04D 15/02; E06C 7/488
See application file for complete search history.

(56) References Cited

U.S. PATENT DOCUMENTS 988,808 A * 4/1911 Parris ..... E04G 3/265 182/45
D254,534 S 3/1980 Glynn
4,401,184 A * 8/1983 Sherry ..... E04G 3/265 182/45
4,860,518 A * 8/1989 Kingham ..... E04D 15/025 52/148
4,972,922 A * 11/1990 Levine ..... E06C 1/345 182/103
5,054,576 A * 10/1991 Glynn ..... E04G 21/3261 182/3
5,143,170 A * 9/1992 Hunt ..... A62B 35/04 182/3
5,282,597 A * 2/1994 Babcock ..... E04D 13/12 248/237
5,318,148 A 6/1994 Franco
5,320,194 A * 6/1994 Bredijk ..... E04D 15/02 182/45
5,379,859 A 1/1995 Pigman
(Continued)

FOREIGN PATENT DOCUMENTS

DE 102018128308 A1 * 5/2020 ..... E04D 13/12
FR 2824578 A1 * 11/2002 ..... E06C 1/32
NL 1024634 5/2005

*Primary Examiner* — Eret C McNichols
(74) *Attorney, Agent, or Firm* — Kyle A. Fletcher, Esq.

(57) ABSTRACT

The roofing safety system is a safety device. The roofing safety system is configured for use with a pitched roof. The roofing safety system forms an anchor point to which individuals and materials are attached during the installation of the pitched roof. The roofing safety system comprises a plurality of anchor plates, a master spar, and a shingle shelf. The plurality of anchor plates secure the roofing safety system to the pitched roof. The plurality of anchor plates attach to the master spar. The shingle shelf attaches to the plurality of anchor plates. The plurality of anchor plates removably attach to the pitched roof. Any individuals on the pitched roof are anchored to the master spar using a cord and a carabiner. Any roofing materials, such as a plurality of shingles, located on the pitched roof are secured using the shingle shelf.

19 Claims, 4 Drawing Sheets

(56) References Cited

U.S. PATENT DOCUMENTS 5,513,826 A * 5/1996 Lebaron ..... E04D 15/02 248/237
5,624,006 A * 4/1997 Richardson, Jr. ..... E04G 3/26 182/206
5,647,451 A 7/1997 Reichel
5,730,407 A * 3/1998 Ostrobrod ..... A62B 35/0043 182/231
5,845,452 A * 12/1998 Pantano ..... E04G 21/3261 52/698
5,862,880 A 1/1999 Nelson
5,908,083 A * 6/1999 Hamilton ..... E04G 3/26 182/45
5,960,904 A * 10/1999 Ullmann ..... E04G 3/26 182/45
6,269,905 B1 * 8/2001 Smith ..... E04D 15/02 182/45
6,470,646 B1 * 10/2002 Bryant ..... E04G 3/26 182/206
6,668,509 B1 * 12/2003 Krebs ..... E04D 13/12 52/698
6,786,020 B2 * 9/2004 Poldmaa ..... E04D 13/12 52/704
6,932,191 B1 * 8/2005 Schwenk ..... E04G 3/26 182/45
7,617,613 B2 * 11/2009 Merryfield, Jr. ..... B44D 3/38 33/414
7,665,248 B2 * 2/2010 Blackford ..... E04D 13/12 52/27
8,186,479 B2 * 5/2012 Vieira ..... E04G 5/04 182/45
8,505,685 B1 * 8/2013 Rayfield ..... E04G 5/041 182/45
8,573,360 B1 11/2013 Yoder
8,596,414 B1 * 12/2013 Lown ..... E04G 3/265 182/45
8,636,108 B2 * 1/2014 Foster, Sr ..... E04D 15/00 182/45
9,248,323 B1 * 2/2016 Larsen ..... E04G 21/3261
9,744,387 B1 * 8/2017 Hung ..... A62B 35/0068
10,767,376 B2 * 9/2020 Bendall ..... E04G 3/22
11,085,238 B1 * 8/2021 Bancroft ..... E06C 7/48
2005/0166468 A1 * 8/2005 Pierce ..... E04H 9/14 52/23
2006/0059858 A1 * 3/2006 Layman ..... E04D 15/02 52/749.12
2007/0034449 A1 * 2/2007 Leendertse ..... E04G 3/26 182/45
2007/0062761 A1 * 3/2007 Megna ..... E04G 3/26 182/45
2008/0277557 A1 * 11/2008 Vetesnik ..... E04H 12/2238 248/499
2010/0213005 A1 * 8/2010 Sistonen ..... E04G 3/26 182/45
2011/0314763 A1 * 12/2011 Gandellini ..... E04G 21/3261 52/698
2013/0228394 A1 * 9/2013 Sousa ..... E04G 21/3276 182/3
2014/0346312 A1 * 11/2014 Small ..... A62B 35/0068 248/573
2015/0129356 A1 * 5/2015 Strawder ..... E04G 21/328 182/3
2016/0177583 A1 * 6/2016 Kurtz ..... E04G 21/3219 182/45
2016/0326757 A1 * 11/2016 West ..... E04G 21/3276
2017/0259090 A1 * 9/2017 Gaines ..... A62B 35/0068
2017/0361135 A1 * 12/2017 Crookston ..... E04G 21/3276
2019/0030380 A1 * 1/2019 Giroux ..... E04D 13/12
2020/0392748 A1 * 12/2020 Fabbi ..... A62B 35/0062

* cited by examiner

ROOFING SAFETY SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of construction and buildings including scaffolding, more specifically, a scaffolding configured for use with a roof.

SUMMARY OF INVENTION

The roofing safety system is a safety device. The roofing safety system is configured for use with a pitched roof. The roofing safety system forms an anchor point to which individuals and materials are attached during the installation of the pitched roof. The roofing safety system comprises a plurality of anchor plates, a master spar, and a shingle shelf. The plurality of anchor plates secure the roofing safety system to the pitched roof. The plurality of anchor plates attach to the master spar. The shingle shelf attaches to the plurality of anchor plates. The plurality of anchor plates removably attach to the pitched roof. Any individuals on the pitched roof are anchored to the master spar using a cord and a carabiner. Any roofing materials, such as a plurality of shingles, located on the pitched roof are secured using the shingle shelf.

These together with additional objects, features and advantages of the roofing safety system will be readily apparent to those of ordinary skill in the art upon reading the following detailed description of the presently preferred, but nonetheless illustrative, embodiments when taken in conjunction with the accompanying drawings.

In this respect, before explaining the current embodiments of the roofing safety system in detail, it is to be understood that the roofing safety system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the roofing safety system.

It is therefore important that the claims be regarded as including such equivalent construction insofar as they do not depart from the spirit and scope of the roofing safety system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
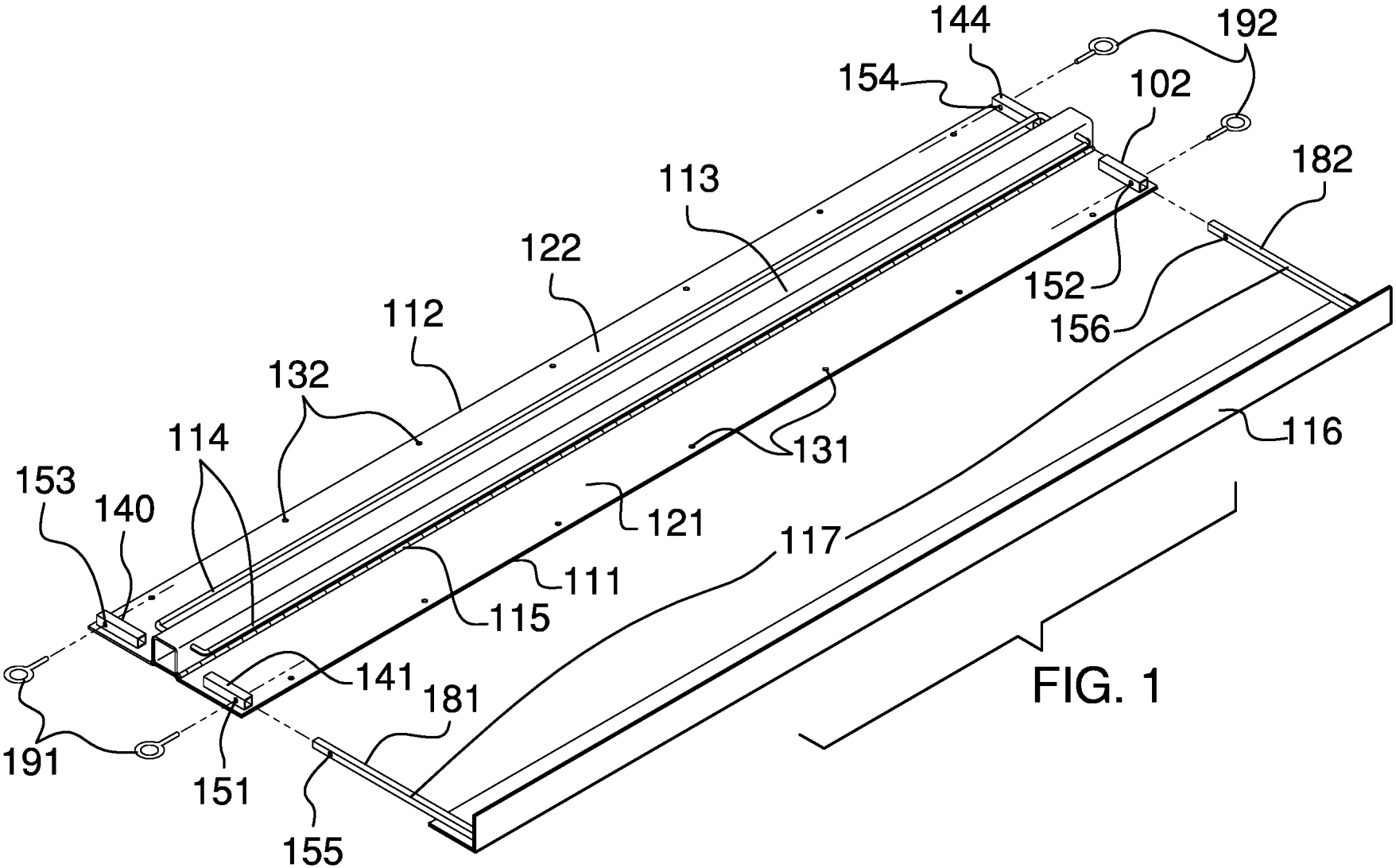
FIG. 1 is a perspective view of an embodiment of the disclosure.
Figure 2:
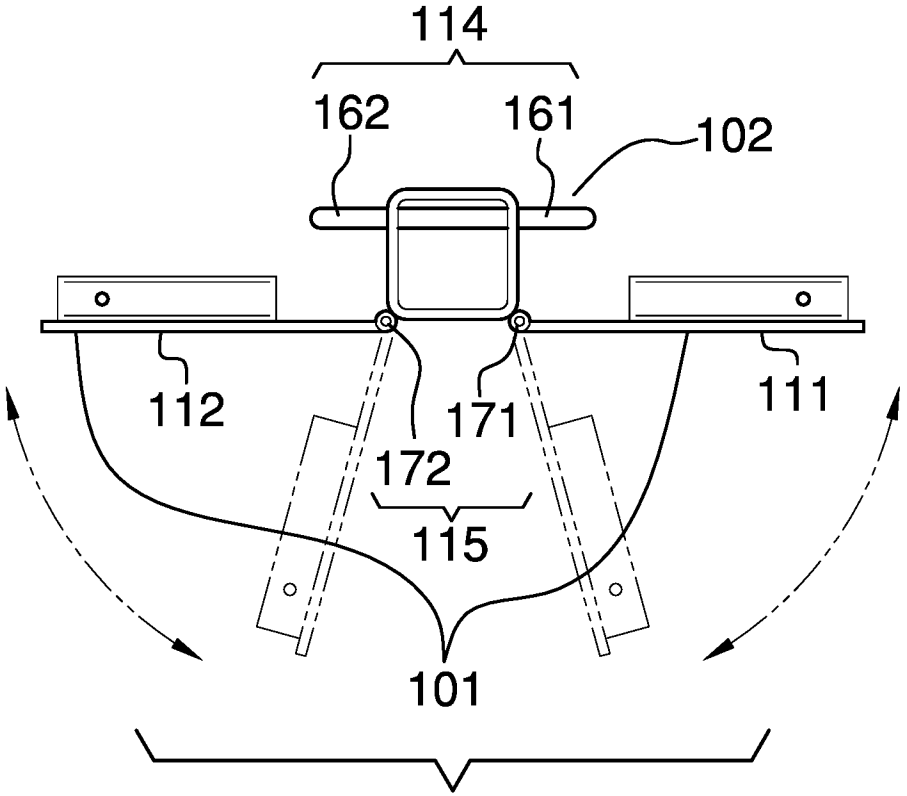
FIG. 2 is a side view of an embodiment of the disclosure.
Figure 3:
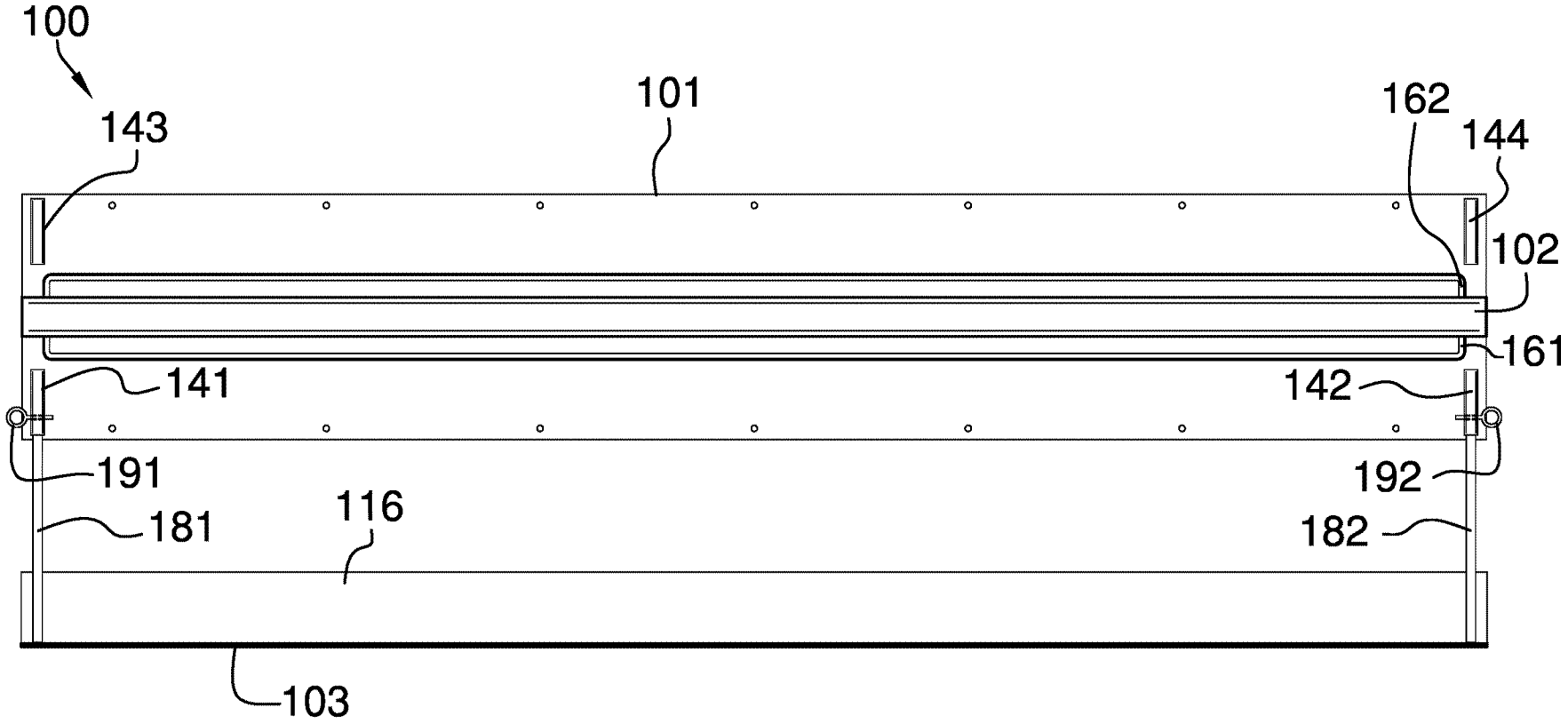
FIG. 3 is a top view of an embodiment of the disclosure.
Figure 4:
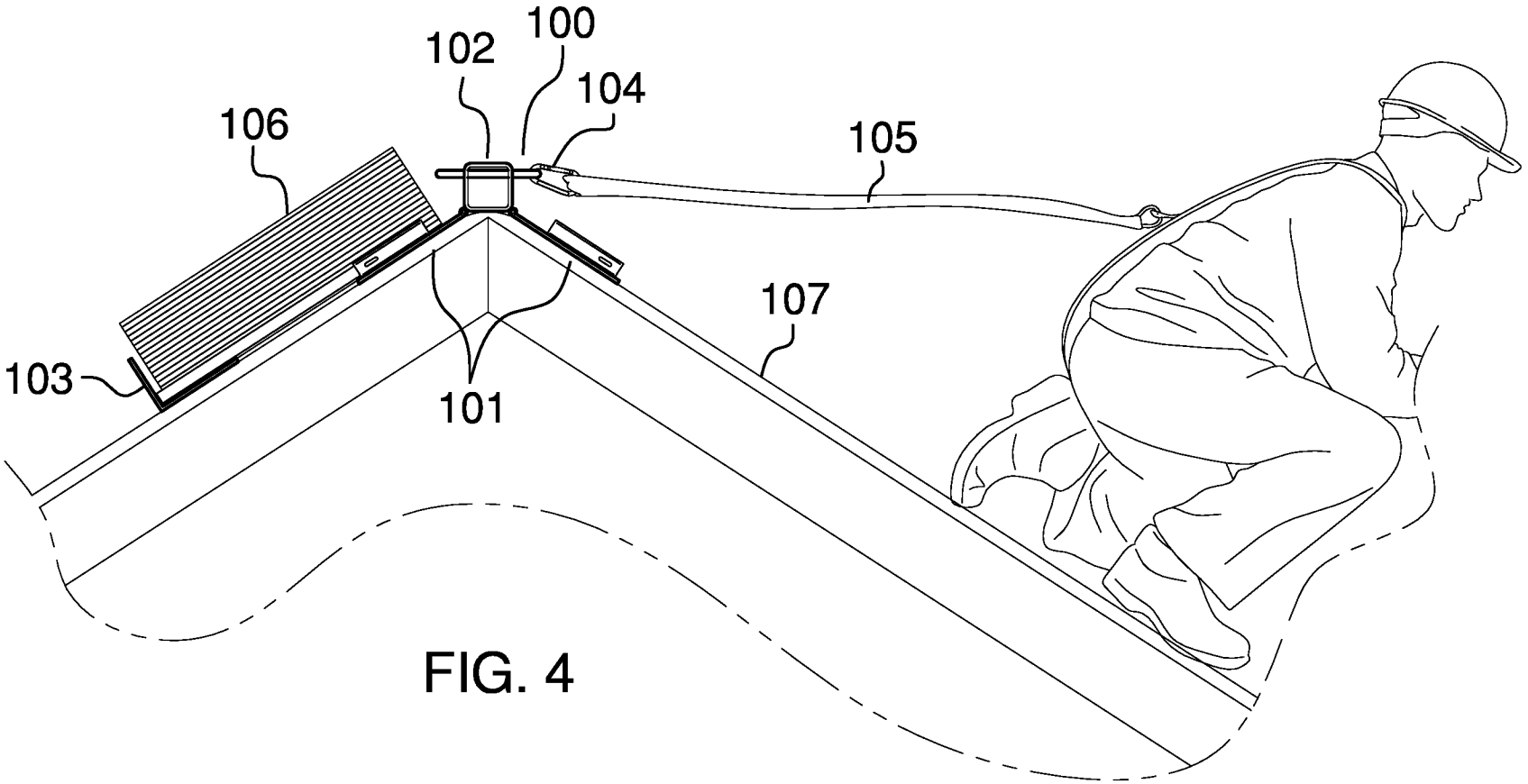
FIG. 4 is an in-use view of an embodiment of the disclosure.

Detailed reference will now be made to one or more potential embodiments of the disclosure, which are illustrated in FIGS. 1 through 4.

The roofing safety system 100 (hereinafter invention) is a safety device. The invention 100 is configured for use with a pitched roof 107. The invention 100 forms an anchor point to which individuals and materials are attached during the installation of the pitched roof 107. The invention 100 comprises a plurality of anchor plates 101, a master spar 102, and a shingle shelf 103. The plurality of anchor plates 101 secure the invention 100 to the pitched roof 107. The plurality of anchor plates 101 attach to the master spar 102. The shingle shelf 103 removably attaches to the plurality of anchor plates 101. The plurality of anchor plates 101 attached to the pitched roof 107. Any individuals on the pitched roof 107 are anchored to the master spar 102 using a cord 105 and a carabiner 104. Any roofing materials, such as a plurality of shingles 106, located on the pitched roof 107 are secured using the shingle shelf 103.

The carabiner 104 is a mechanical device that secures the cord 105 to the master spar 102. Specifically, the carabiner 104 forms a spring-loaded clip that attaches to an anchor rail selected from the group consisting of the first anchor rail 161 and the second anchor rail 162. The carabiner 104 is defined elsewhere in this disclosure.

The cord 105 is a rope used to tether an individual to the master spar 102. The cord 105 is defined elsewhere in this disclosure. The shingle is defined elsewhere in this disclosure. The pitched roof 107 is defined elsewhere in this disclosure.

Each of the plurality of anchor plates 101 is a disk-shaped structure. Each of the plurality of anchor plates 101 attaches to the decking of the pitched roof 107 during the construction of the pitched roof 107. Each of the plurality of anchor plates 101 attaches to the decking of the pitched roof 107 such that the master spar 102 aligns with the brink formed by the decking surfaces of the pitched roof 107 that forms the superior edge of the pitched roof 107. The longest edge of each of the plurality of anchor plates 101 aligns with the brink formed by the decking surfaces of the pitched roof 107. Each of the plurality of anchor plates 101 screws into the decking of the pitched roof 107. Every decking surface that forms the brink formed by the decking surfaces of the pitched roof 107 has at least one anchor plate selected from the plurality of anchor plates 101 attached to it.

The plurality of anchor plates 101 comprises a first anchor plate 111 and a second anchor plate 112.

The first anchor plate 111 is a disk-shaped plate. The first anchor plate 111 is a rigid structure. The first anchor plate 111 attaches to the lateral face of the prism structure of the square tube 113 of the master spar 102. The first anchor plate 111 attaches to the square tube 113 of the master spar 102 such that the first anchor plate 111 rotates relative to the master spar 102. The first anchor plate 111 attaches to the square tube 113 such that the longest end of the first anchor plate 111 is parallel to a first brink of the lateral face of the prism structure of the square tube 113. The first anchor plate 111 secures the invention 100 of the pitched roof 107 by screwing into the decking of the pitched roof 107. The first anchor plate 111 comprises a first pedestal disk 121, a first plurality of anchor nuts 131, a first latch pod 141, and a second latch pod 142.

The first pedestal disk 121 is a disk-shaped structure. The first pedestal disk 121 is a rigid structure. The first pedestal disk 121 physically attaches the first anchor plate 111 to the decking of the pitched roof 107. The first pedestal disk 121 physically attaches to the master spar 102 such that the first pedestal disk 121 rotates relative to the master spar 102. The shingle shelf 103 removably attaches to the first pedestal disk 121 by removably attaching to the plurality of jibs 117.

Each of the first plurality of anchor nuts 131 is a disk-shaped negative space that is formed through the congruent ends of the disk structure of the first pedestal disk 121. Each of the first plurality of anchor nuts 131 is sized to receive a screw. The first pedestal disk 121 is screwed to the decking of the pitched roof 107 by screwing a screw through each of the first plurality of anchor nuts 131 into the decking of the pitched roof 107.

The first latch pod 141 is a prism-shaped tubular structure. The congruent end of the first latch pod 141 is geometrically similar to the congruent end of each of the plurality of jibs 117. The first latch pod 141 is sized such that any jib selected from the plurality of jibs 117 will insert into the first latch pod 141. The first latch pod 141 attaches to a congruent end of the disk structure of the first pedestal disk 121 such that the center axis of the prism structure of the first latch pod 141 is perpendicular to the longest lateral face of the disk structure of the first pedestal disk 121. The longest lateral face of the disk structure of the first pedestal disk 121 is also the longest edge of the first pedestal disk 121. The first latch pod 141 further comprises a first radial hole 151.

The first radial hole 151 is a radial hole formed through the prism structure of the first latch pod 141. The inner dimension of the first radial hole 151 is sized to receive the first cotter pin 191.

The second latch pod 142 is a prism-shaped tubular structure. The congruent end of the second latch pod 142 is geometrically similar to the congruent end of each of the plurality of jibs 117. The second latch pod 142 is sized such that any jib selected from the plurality of jibs 117 will insert into the second latch pod 142. The second latch pod 142 attaches to a congruent end of the disk structure of the first pedestal disk 121 such that the center axis of the prism structure of the second latch pod 142 is perpendicular to the longest lateral face of the disk structure of the first pedestal disk 121. The longest lateral face of the disk structure of the first pedestal disk 121 is also the longest edge of the first pedestal disk 121. The second latch pod 142 further comprises a second radial hole 152.

The second radial hole 152 is a radial hole formed through the prism structure of the second latch pod 142. The inner dimension of the second radial hole 152 is sized to receive the second cotter pin 192.

The span of the distance between the center axis of the prism structure first latch pod 141 and the center axis of the prism structure of the second latch pod 142 is equal to the span of the distance between the center axis of the prism structure of the first jib 181 and the center axis of the prism structure of the second jib 182 such that the second jib 182 will insert into the second latch pod 142 simultaneously with the insertion of the first jib 181 into the second latch pod 142.

The second anchor plate 112 is a disk-shaped plate. The second anchor plate 112 is a rigid structure. The second anchor plate 112 attaches to the lateral face of the prism structure of the square tube 113 of the master spar 102. The second anchor plate 112 attaches to the square tube 113 of the master spar 102 such that the second anchor plate 112 rotates relative to the master spar 102. The second anchor plate 112 attaches to the square tube 113 such that the longest end of the second anchor plate 112 is parallel to a second brink of the lateral face of the prism structure of the square tube 113. The second brink of the square tube 113 is a brink of the square tube 113 that is adjacent to the first brink. The second anchor plate 112 secures the invention 100 of the pitched roof 107 by screwing into the decking of the pitched roof 107. The second anchor plate 112 comprises a second pedestal disk 122, a second plurality of anchor nuts 132, a third latch pod 143, and a fourth latch pod 144.

The second pedestal disk 122 is a disk-shaped structure. The second pedestal disk 122 is a rigid structure. The second pedestal disk 122 physically attaches the second anchor plate 112 to the decking of the pitched roof 107. The second pedestal disk 122 physically attaches to the master spar 102 such that the second pedestal disk 122 rotates relative to the master spar 102. The shingle shelf 103 removably attaches to the second pedestal disk 122 by removably attaching to the plurality of jibs 117.

Each of the second plurality of anchor nuts 132 is a disk-shaped negative space that is formed through the congruent ends of the disk structure of the second pedestal disk 122. Each of the second plurality of anchor nuts 132 is sized to receive a screw. The second pedestal disk 122 is screwed to the decking of the pitched roof 107 by screwing a screw through each of the second plurality of anchor nuts 132 into the decking of the pitched roof 107.

The third latch pod 143 is a prism-shaped tubular structure. The congruent end of the third latch pod 143 is geometrically similar to the congruent end of each of the plurality of jibs 117. The third latch pod 143 is sized such that any jib selected from the plurality of jibs 117 will insert into the third latch pod 143. The third latch pod 143 attaches to a congruent end of the disk structure of the second pedestal disk 122 such that the center axis of the prism structure of the third latch pod 143 is perpendicular to the longest lateral face of the disk structure of the second pedestal disk 122. The longest lateral face of the disk structure of the second pedestal disk 122 is also the longest edge of the second pedestal disk 122. The third latch pod 143 further comprises a third radial hole 153.

The third radial hole 153 is a radial hole formed through the prism structure of the third latch pod 143. The inner dimension of the third radial hole 153 is sized to receive the first cotter pin 191.

The fourth latch pod 144 is a prism-shaped tubular structure. The congruent end of the fourth latch pod 144 is geometrically similar to the congruent end of each of the plurality of jibs 117. The fourth latch pod 144 is sized such that any jib selected from the plurality of jibs 117 will insert into the fourth latch pod 144. The fourth latch pod 144 attaches to a congruent end of the disk structure of the second pedestal disk 122 such that the center axis of the prism structure of the fourth latch pod 144 is perpendicular to the longest lateral face of the disk structure of the second pedestal disk 122. The longest lateral face of the disk structure of the second pedestal disk 122 is also the longest edge of the second pedestal disk 122. The fourth latch pod 144 further comprises a fourth radial hole 154.

The fourth radial hole 154 is a radial hole formed through the prism structure of the fourth latch pod 144. The inner dimension of the fourth radial hole 154 is sized to receive the second cotter pin 192.

The span of the distance between the center axis of the prism structure third latch pod 143 and the center axis of the prism structure of the fourth latch pod 144 is equal to the span of the distance between the center axis of the prism structure of the first jib 181 and the center axis of the prism structure of the second jib 182 such that the second jib 182 will insert into the fourth latch pod 144 simultaneously with the insertion of the first jib 181 into the fourth latch pod 144.

The master spar 102 is a mechanical structure. The master spar 102 attaches to the longest edge of each of the plurality of anchor plates 101 such that each anchor plate selected from the plurality of anchor plates 101 rotates relative to the master spar 102. Each of the plurality of anchor plates 101 attaches to the longest edge of each of the master spar 102 such that the center axis of the prism structure of the square tube 113 of the master spar 102 aligns with the brink formed by the decking surfaces of the pitched roof 107. The master spar 102 forms an anchor point for use by any individual working on the pitched roof 107. The master spar 102 comprises a square tube 113, a plurality of anchor rails 114, a plurality of piano hinges 115.

The square tube 113 is a prism-shaped structure. The square tube 113 is a rigid structure. The square tube 113 has the tubular shape. The first anchor plate 111 and the second anchor plate 112 attach the square tube 113 to the superior brink of the pitched roof 107 such that the center axis of the prism structure of the square tube 113 is parallel to the edge formed by the superior brink.

Each of the plurality of anchor rails 114 is a rigid structure. Each of the plurality of anchor rails 114 is a U-shaped structure. Each of the plurality of anchor rails 114 attaches to the lateral face of the prism structure of the square tube 113. Each of the plurality of anchor rails 114 forms an anchor point to which the carabiner 104 attaches. The plurality of anchor rails 114 further comprises a first anchor rail 161 and a second anchor rail 162.

The first anchor rail 161 is a rigid structure. The first anchor rail 161 is a U-shaped structure. The free end of each arm of the U-shaped structure of the first anchor rail 161 attaches to a lateral face of the prism structure of the square tube 113 that is adjacent to the first brink to which the first piano hinge 171 attaches.

The second anchor rail 162 is a rigid structure. The second anchor rail 162 is a U-shaped structure. The free end of each arm of the U-shaped structure of the second anchor rail 162 attaches to a lateral face of the prism structure of the square tube 113 that is adjacent to the second brink to which the second piano hinge 172 attaches. The second anchor rail 162 attaches to the lateral face of the prism structure of the square tube 113 that is distal from the lateral face to which the first anchor rail 161 attaches.

Each of the plurality of piano hinges 115 attaches an anchor plate selected from the plurality of anchor plates 101 to a brink of the lateral face of the master spar 102. The plurality of piano hinges 115 further comprises a first piano hinge 171 and a second piano hinge 172.

The first piano hinge 171 is a hinge that attaches the first anchor plate 111 of the plurality of anchor plates 101 to a first brink of the lateral face of the prism structure of the square tube 113 of the master spar 102. The first piano hinge 171 attaches the first anchor plate 111 to the square tube 113 such that the first anchor plate 111 rotates relative to the square tube 113. The rotation of the first piano hinge 171 allows the position of the first anchor plate 111 relative to the square tube 113 to adjust to accommodate variations in the pitch angle between different pitched roof 107.

The second piano hinge 172 is a hinge that attaches the second anchor plate 112 of the plurality of anchor plates 101 to a second brink of the lateral face of the prism structure of the square tube 113 of the master spar 102. The second brink is a brink formed in the lateral face of the square tube 113 that is adjacent to the first brink. The second piano hinge 172 attaches the second anchor plate 112 to the square tube 113 such that the second anchor plate 112 rotates relative to the square tube 113. The rotation of the second piano hinge 172 allows the position of the second anchor plate 112 relative to the square tube 113 to adjust to accommodate variations in the pitch angle between different pitched roof 107. The piano hinge is defined elsewhere in this disclosure.

The shingle shelf 103 is a mechanical structure. The shingle shelf 103 attaches to an anchor plate selected from the plurality of anchor plates 101. Specifically, the shingle shelf 103 attaches to an anchor plate selected from the group consisting of the first anchor plate 111 and the second anchor plate 112. The shingle shelf 103 secures the plurality of shingles 106 to the invention 100 such that the plurality of shingles 106 will not slide down the pitch of the pitched roof 107. The shingle shelf 103 comprises an angle iron 116, a plurality of jibs 117, a first cotter pin 191, and a second cotter pin 192.

The angle iron 116 is a rigid structure. The angle iron 116 forms a hook like structure that forms a barrier that prevents the plurality of shingles 106 from sliding down the pitched roof 107. The angle iron 116 is defined elsewhere in this disclosure.

The plurality of jibs 117 is a prism-shaped structure. The plurality of jibs 117 is a rigid structure. Each of the plurality of jibs 117 are identical. Each of the plurality of jibs 117 attaches to the angle iron 116 in the manner of a cantilever. The free end of each of the plurality of jibs 117 removably attaches to an anchor plate selected from the plurality of anchor plates 101. The plurality of jibs 117 attach to the angle iron 116 to form a U-shaped structure. The plurality of jibs 117 combine to form an extension structure that separates the angle iron 116 from the selected anchor plate to which the plurality of jibs 117 attach. The plurality of jibs 117 separates the angle iron 116 from the selected anchor plate such that the plurality of shingles 106 will fit between the plurality of jibs 117 and the selected anchor plate. The plurality of jibs 117 comprises a first jib 181 and a second jib 182.

The first jib 181 is a prism-shaped structure. The first jib 181 is a rigid structure. The first jib 181 is geometrically similar to the congruent ends of both the first latch pod 141 and the third latch pod 143 such that the first jib 181 inserts into the congruent end of a latch pod selected from the group consisting of the first latch pod 141 and the third latch pod 143. The first jib 181 is an extension structure that forms and controls the reach between the master spar 102 and the angle iron 116 of the shingle shelf 103.

The first jib 181 attaches to the first latch pod 141 by inserting the first jib 181 into the first latch pod 141 such that the first radial hole 151 aligns with the fifth radial hole 155. The first cotter pin 191 is then inserted simultaneously through the first radial hole 151 and the fifth radial hole 155 while they are aligned. The first jib 181 attaches to the third latch pod 143 by inserting the first jib 181 into the third latch pod 143 such that the third radial hole 153 aligns with the fifth radial hole 155. The first cotter pin 191 is then inserted simultaneously through the third radial hole 153 and the fifth radial hole 155 while they are aligned. The first jib 181 further comprises a fifth radial hole 155.

The fifth radial hole 155 is a radial hole formed through the prism structure of the first jib 181. The inner dimension of the fifth radial hole 155 is sized to receive the first cotter pin 191. The position of the fifth radial hole 155 is such that the fifth radial hole 155 aligns with the first radial hole 151 when the first jib 181 inserts into the first latch pod 141. The position of the fifth radial hole 155 is such that the fifth radial hole 155 aligns with the third radial hole 153 when the first jib 181 inserts into the third latch pod 143.

The second jib 182 is a prism-shaped structure. The second jib 182 is a rigid structure. The second jib 182 is geometrically similar to the congruent ends of both the second latch pod 142 and the fourth latch pod 144 such that the second jib 182 inserts into the congruent end of a latch pod selected from the group consisting of the second latch pod 142 and the fourth latch pod 144. The second jib 182 is an extension structure that forms and controls the reach between the master spar 102 and the angle iron 116 of the shingle shelf 103.

The second jib 182 attaches to the second latch pod 142 by inserting the second jib 182 into the second latch pod 142 such that the second radial hole 152 aligns with the sixth radial hole 156. The second cotter pin 192 is then inserted simultaneously through the second radial hole 152 and the sixth radial hole 156 while they are aligned. The second jib 182 attaches to the fourth latch pod 144 by inserting the second jib 182 into the fourth latch pod 144 such that the fourth radial hole 154 aligns with the sixth radial hole 156. The second cotter pin 192 is then inserted simultaneously through the fourth radial hole 154 and the sixth radial hole 156 while they are aligned. The second jib 182 further comprises a sixth radial hole 156.

The sixth radial hole 156 is a radial hole formed through the prism structure of the second jib 182. The inner dimension of the sixth radial hole 156 is sized to receive the second cotter pin 192. The position of the sixth radial hole 156 is such that the sixth radial hole 156 aligns with the second radial hole 152 when the second jib 182 inserts into the second latch pod 142. The position of the sixth radial hole 156 is such that the sixth radial hole 156 aligns with the fourth radial hole 154 when the second jib 182 inserts into the fourth latch pod 144.

The first cotter pin 191 is a prism-shaped structure. The first cotter pin 191 is a rigid structure. The first cotter pin 191 forms an attachment selected from the group consisting of: a) attaching the first jib 181 to the first latch pod 141 of the first anchor plate 111; and, b) attaching the first jib 181 to the third latch pod 143 of the second anchor plate 112. The first cotter pin 191 simultaneously inserts through both the first radial hole 151 of the first anchor plate 111 and the fifth radial hole 155 of the first jib 181 to attach the first jib 181 to the first latch pod 141. The first cotter pin 191 simultaneously inserts through both the third radial hole 153 of the second anchor plate 112 and the fifth radial hole 155 of the first jib 181 to attach the first jib 181 to the third latch pod 143.

The second cotter pin 192 is a prism-shaped structure. The second cotter pin 192 is a rigid structure. The second cotter pin 192 forms an attachment selected from the group consisting of: a) attaching the second jib 182 to the second latch pod 142 of the first anchor plate 111; and, b) attaching the second jib to the fourth latch pod 144 of the second anchor plate 112. The second cotter pin 192 simultaneously inserts through both the second radial hole 152 of the first anchor plate 111 and the sixth radial hole 156 of the second jib 182 to attach the second jib 182 to the second latch pod 142. The second cotter pin 192 simultaneously inserts through both the fourth radial hole 154 of the second anchor plate 112 and the sixth radial hole 156 of the second jib 182 to attach the second jib 182 to the fourth latch pod 144.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Angle Iron: As used in this disclosure, an angle iron is a metal plate that forms a right angle along the direction of the metal plate with the longest span.

Brink: As used in this disclosure, a brink refers to the edge or line formed by the intersection of a first plane or surface and a second plane or surface wherein a cant exists between the first plane or surface and the second plane or surface.

Cant: As used in this disclosure, a cant is an angular deviation from one or more reference lines (or planes) such as a vertical line (or plane) or a horizontal line (or plane).

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Carabiner: As used in this disclosure, a carabiner is coupling link that is usually formed as an oblong metal ring with one spring hinged side that is used to open and close the ring.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects.

Correspond: As used in this disclosure, the term correspond is used as a comparison between two or more objects wherein one or more properties shared by the two or more objects match, agree, or align within acceptable manufacturing tolerances.

Cotter Pin: As used in this disclosure, a cotter pin is a metal shaft that is used to hold two mechanical components together. The cotter pin typically simultaneously inserts through two holes, one formed in each of the mechanical components.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Diametrically Opposed: As used in this disclosure, diametrically opposed is a term that describes the locations of a first object and a second object located at opposite ends of a diameter drawn through a third object. The term diametric opposition can also be used to describe this relationship.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hinge: As used in this disclosure, a hinge is a device that permits the turning, rotating, or pivoting of a first object relative to a second object. A hinge designed to be fixed into a set position after rotation is called a locking hinge.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Inner Diameter: As used in this disclosure, the term inner diameter is used in the same way that a plumber would refer to the inner diameter of a pipe.

Jib: As used in this disclosure, a jib is a beam structure that: 1) is mounted with a free end in the manner of a cantilever; and, 2) attaches a load at the free end of the jib.

Lateral Disk Structure: As used in this disclosure, a lateral plate structure refers to the juxtaposition of a first lateral face of a first disk-shaped structure to a second lateral face of a second disk-shaped structure such that: a) the center axes of the first disk and the second disk are parallel; and, b) the congruent ends of the first disk are parallel to the congruent ends of the second disk. The span of the length of the center axes of the first disk and the second disk need not be equal. The form factor of the congruent ends of the first disk and the second disk need not be geometrically similar.

Lateral Prism Structure: As used in this disclosure, a lateral prism structure refers to the juxtaposition of a first lateral face of a first prism structure to a second lateral face of a second prism structure such that: a) the center axes of the first prism and the second prism are parallel; and, b) the congruent ends of the first prism are parallel to the congruent ends of the second prism. The span of the length of the center axes of the first prism and the second prism need not be equal. The form factor of the congruent ends of the first prism and the second prism need not be geometrically similar.

Negative Space: As used in this disclosure, negative space is a method of defining an object through the use of open or empty space as the definition of the object itself, or, through the use of open or empty space to describe the boundaries of an object.

Nut: As used in this disclosure, a nut is a prism or disk-shaped negative space that is formed through a surface. The nut is sized to a shaft to be inserted through the congruent ends of the prism or disk-shaped negative space. A nut is further defined with an inner diameter.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Diameter: As used in this disclosure, the term outer diameter is used in the same way that a plumber would refer to the outer diameter of a pipe.

Perimeter: As used in this disclosure, a perimeter is one or more curved or straight lines that bounds an enclosed area on a plane or surface. The perimeter of a circle is commonly referred to as a circumference.

Piano Hinge: As used in this disclosure, a piano hinge is: 1) a hinge that is longer than 12 inches; and 2) has a pin that runs fully along at least one of the surfaces that the piano hinge is attached to. Piano hinges are also commonly referred to as continuous hinges.

Pitched Roof: As used in this disclosure, a pitched roof refers to a roof wherein the surface of the roof forms an angle relative to the horizon.

Plate: As used in this disclosure, a plate is a smooth, flat and semi-rigid or rigid structure that has at least one dimension that: a) is of uniform thickness; and b) that appears thin relative to the other dimensions of the object. Plates often have a rectangular appearance. Plates often have a disk-like structure. The face of the plate is a surface of the plate selected from the group consisting of: a) the surface of the plate with the greatest surface area; b) the surface of the plate that is distal from the surface of the plate with the greatest surface area. The edges of the plate comprises the surfaces of the plate that would not be considered faces as defined above. As defined in this disclosure, plates may be made of any material, but are commonly made of metal, plastic, and wood. When made of wood, a plate is often referred to as a board or a plank.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Radial hole: As used in this disclosure, a radial hole comprises a hole that is formed through a solid cylinder such that: 1) the formed hole is cylindrical; 2) the center axis of the formed hole is perpendicular to the center axis of the solid cylinder; and, 3) the center axis of the formed hole intersects the center axis of the solid cylinder. When the term radial hole is applied to a pipe, or other hollow cylindrical object, the term applies to two holes that are formed in the surface of the pipe in a manner that is consistent with the solid cylinder definition. When the term radial hole is applied to a prism formed from an N-gon when N is an even number, the assumption should be made that the center axis is formed by a line that connects the center of the first corresponding face of the prism to the center of the second corresponding face of the prism.

Rail: As used in this disclosure, a rail is a continuous structure that forms a track that is used to guide the motion of an object.

Rigid Structure: As used in this disclosure, a rigid structure is a solid structure formed from an inelastic material that resists changes in shape. A rigid structure will permanently deform as it fails under a force. See bimodal flexible structure.

Roof: As used in this disclosure, a roof is the exterior surface of a structure that is distal from the surface upon which the structure is placed. As used in this disclosure, the exterior surface is assumed to include the supporting structures associated with the exterior surface including, but not limited to, rafters, decking, soffits, and fascia. A pitched roof is a roof wherein the surface of the roof has a cant that is not perpendicular to the direction of gravity. Screw: As used in this disclosure, to screw is a verb meaning: 1) to fasten or unfasten (unscrew) a threaded connection; or 2) to attach a helical structure to a solid structure.

Screw: As used in this disclosure, a screw is a cylindrical, or tapered cylindrical, structure that is formed with an exterior screw thread. A screw is used to attach a first object to a second object. Screws are well known and documented in the mechanical arts.

Shingle: As used in this disclosure, a shingle is a disk-shaped tile that is used to form the superior surface of a roof. Shingle are overlapped such that water is routed along the pitch without leaking beneath the layer of shingles.

Slide: As used in this disclosure, slide is a verb that refers to an object that is transported along a surface while in continuous contact with the surface. An object being transported along a surface with wheels cannot be said to be sliding.

Spar: As used in this disclosure, a spar is a horizontally oriented load bearing beam that forms the superior element of a structure.

Superior: As used in this disclosure, the term superior refers to a directional reference that is parallel to and in the opposite direction of the force of gravity when an object is positioned or used normally.

Track: As used in this disclosure, a track is a physical structural relationship between a first object and a second object that serves a purpose selected from the group consisting of: 1) fastening the second object to the first object; 2) controlling the path of motion of the first object relative to the second object in at least one dimension and in a maximum of two dimensions; or, 3) a combination of the first two elements of this group.

Tube: As used in this disclosure, the term tube is used to describe a rigid hollow prism-shaped device with two open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

U-Shaped Structure: As used in this disclosure, a U-shaped structure refers to a three-sided structure comprising a crossbeam, a first arm, and a second arm. In a U-shaped structure, the first arm and the second arm project away from the crossbeam: 1) in the same direction; 2) at roughly equivalent angles to the crossbeam, and, 3) the span of the length of the first arm roughly equals the span of the length of the second arm. The first arm and the second arm project away from the crossbeam in the manner of a cantilever.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A roofing safety system comprising a plurality of anchor plates, a master spar, and a shingle shelf;

wherein the plurality of anchor plates attach to the master spar;

wherein the shingle shelf removably attaches to the plurality of anchor plates;

wherein the roofing safety system is configured for use with a pitched roof;

wherein the plurality of anchor plates are attached to the pitched roof;

wherein the plurality of anchor plates secure the roofing safety system to the pitched roof;

wherein the roofing safety system forms an anchor point;

wherein the roofing safety system is configured for use with a plurality of shingles;

wherein the master spar comprises a square tube, a plurality of anchor rails, a plurality of piano hinges;

wherein each of the plurality of anchor rails attaches to a lateral face of a prism structure of the square tube;

wherein each of the plurality of piano hinges attaches an anchor plate selected from the plurality of anchor plates to a brink of the lateral face of the master spar.

2. The roofing safety system according to claim 1 wherein each of the plurality of anchor plates attaches to a decking of the pitched roof;

wherein each of the plurality of anchor plates attaches to the decking of the pitched roof such that the master spar aligns with a brink formed at the decking surface of the pitched roof;

wherein a longest edge of each of the plurality of anchor plates aligns with the brink formed by the decking surfaces of the pitched roof.

3. The roofing safety system according to claim 2 wherein the master spar is a mechanical structure;

wherein the master spar attaches to the longest edge of each of the plurality of anchor plates such that each anchor plate selected from the plurality of anchor plates rotates relative to the master spar;

wherein each of the plurality of anchor plates attaches to a longest edge of each of the master spar such that a center axis of a prism structure of the square tube of the master spar aligns with the brink formed by the decking of the pitched roof;

wherein the master spar forms the anchor point.

4. The roofing safety system according to claim 3 wherein the shingle shelf is a mechanical structure;

wherein the shingle shelf attaches to an anchor plate selected from the plurality of anchor plates;

wherein the shingle shelf secures the plurality of shingles to the roofing safety system such that the plurality of shingles will not slide down the pitched roof.

5. The roofing safety system according to claim 4 wherein the plurality of anchor plates comprises a first anchor plate and a second anchor plate;

wherein the first anchor plate is a plate;

wherein the first anchor plate is a rigid structure;

wherein the first anchor plate attaches to the master spar;

wherein the first anchor plate attaches to the master spar such that the first anchor plate rotates relative to the master spar;

wherein the second anchor plate is a plate;

wherein the second anchor plate is a rigid structure;

wherein the second anchor plate attaches to the master spar;

wherein the second anchor plate attaches to the master spar such that the second anchor plate rotates relative to the master spar.

6. The roofing safety system according to claim 5 wherein the shingle shelf comprises an angle iron, a plurality of jibs, a first cotter pin, and a second cotter pin;

wherein each of the plurality of jibs attaches to the angle iron in the manner of a cantilever;

wherein the free end of each of the plurality of jibs removably attaches to an anchor plate selected from the plurality of anchor plates;

wherein the first cotter pin forms an attachment selected from the group consisting of: a) attaching the first jib to the first anchor plate; and, b) attaching the first jib to the second anchor plate;

wherein the second cotter pin forms an attachment selected from the group consisting of: a) attaching the second jib to the first anchor plate; and, b) attaching the second jib to the second anchor plate.

7. The roofing safety system according to claim 6 wherein the shingle shelf attaches to an anchor plate selected from the group consisting of the first anchor plate and the second anchor plate.

8. The roofing safety system according to claim 7 wherein the first anchor plate attaches to the lateral face of the prism structure of the square tube of the master spar;

wherein the first anchor plate attaches to the square tube of the master spar such that the first anchor plate rotates relative to the master spar;

wherein the first anchor plate attaches to the square tube such that the longest end of the first anchor plate is parallel to a first brink of the lateral face of the prism structure of the square tube;

wherein the second anchor plate attaches to the lateral face of the prism structure of the square tube of the master spar;

wherein the second anchor plate attaches to the square tube of the master spar such that the second anchor plate rotates relative to the master spar;

wherein the second anchor plate attaches to the square tube such that the longest end of the second anchor plate is parallel to a second brink of the lateral face of the prism structure of the square tube;

wherein the second brink of the square tube is a brink of the square tube that is adjacent to the first brink.

9. The roofing safety system according to claim 8 wherein the first anchor plate comprises a first pedestal disk, a first plurality of anchor nuts, a first latch pod, and a second latch pod;

wherein the first pedestal disk physically attaches the first anchor plate to the decking of the pitched roof;

wherein each of the first plurality of anchor nuts is a negative space that is formed through the congruent ends of the disk structure of the first pedestal disk;

wherein the first latch pod attaches to a congruent end of the disk structure of the first pedestal disk such that the center axis of the prism structure of the first latch pod is perpendicular to the longest lateral face of the disk structure of the first pedestal disk;

wherein the second latch pod attaches to a congruent end of the disk structure of the first pedestal disk such that the center axis of the prism structure of the second latch pod is perpendicular to the longest lateral face of the disk structure of the first pedestal disk.

10. The roofing safety system according to claim 9 wherein the second anchor plate comprises a second pedestal disk, a second plurality of anchor nuts, a third latch pod, and a fourth latch pod;

wherein the second pedestal disk physically attaches to the master spar such that the second pedestal disk rotates relative to the master spar;

wherein each of the second plurality of anchor nuts is a negative space that is formed through the congruent ends of the disk structure of the second pedestal disk;

wherein the third latch pod attaches to a congruent end of the disk structure of the second pedestal disk such that the center axis of the prism structure of the third latch pod is perpendicular to the longest lateral face of the disk structure of the second pedestal disk;

wherein the fourth latch pod attaches to a congruent end of the disk structure of the second pedestal disk such that the center axis of the prism structure of the fourth latch pod is perpendicular to the longest lateral face of the disk structure of the second pedestal disk.

11. The roofing safety system according to claim 10 wherein the first pedestal disk is a rigid structure;

wherein the first pedestal disk physically attaches to the master spar such that the first pedestal disk rotates relative to the master spar;

wherein the shingle shelf removably attaches to the first pedestal disk by removably attaching to the plurality of jibs;

wherein the second pedestal disk is a rigid structure;

wherein the second pedestal disk physically attaches the second anchor plate to the decking of the pitched roof;

wherein the shingle shelf removably attaches to the second pedestal disk by removably attaching to the plurality of jibs.

12. The roofing safety system according to claim 11 wherein the first latch pod is a prism-shaped tubular structure;

wherein the congruent end of the first latch pod is geometrically similar to the congruent end of each of the plurality of jibs;

wherein the first latch pod is sized such that any jib selected from the plurality of jibs will insert into the first latch pod;

wherein the longest lateral face of the disk structure of the first pedestal disk is also the longest edge of the first pedestal disk;

wherein the first latch pod further comprises a first radial hole;

wherein the first radial hole is a radial hole formed through the prism structure of the first latch pod;

wherein the inner dimension of the first radial hole is sized to receive the first cotter pin;

wherein the second latch pod is a prism-shaped tubular structure;

wherein the congruent end of the second latch pod is geometrically similar to the congruent end of each of the plurality of jibs;

wherein the second latch pod is sized such that any jib selected from the plurality of jibs will insert into the second latch pod;

wherein the longest lateral face of the disk structure of the first pedestal disk is also the longest edge of the first pedestal disk;

wherein the second latch pod further comprises a second radial hole;

wherein the second radial hole is a radial hole formed through the prism structure of the second latch pod;

wherein the inner dimension of the second radial hole is sized to receive the second cotter pin;

wherein the third latch pod is a prism-shaped tubular structure;

wherein the congruent end of the third latch pod is geometrically similar to the congruent end of each of the plurality of jibs;

wherein the third latch pod is sized such that any jib selected from the plurality of jibs will insert into the third latch pod;

wherein the longest lateral face of the disk structure of the second pedestal disk is also the longest edge of the second pedestal disk;

wherein the third latch pod further comprises a third radial hole;

wherein the third radial hole is a radial hole formed through the prism structure of the third latch pod;

wherein the inner dimension of the third radial hole is sized to receive the first cotter pin;

wherein the fourth latch pod is a prism-shaped tubular structure;

wherein the congruent end of the fourth latch pod is geometrically similar to the congruent end of each of the plurality of jibs;

wherein the fourth latch pod is sized such that any jib selected from the plurality of jibs will insert into the fourth latch pod;

wherein the longest lateral face of the disk structure of the second pedestal disk is also the longest edge of the second pedestal disk;

wherein the fourth latch pod further comprises a fourth radial hole;

wherein the fourth radial hole is a radial hole formed through the prism structure of the fourth latch pod;

wherein the inner dimension of the fourth radial hole is sized to receive the second cotter pin.

13. The roofing safety system according to claim 12 wherein the span of the distance between the center axis of the prism structure first latch pod and the center axis of the prism structure of the second latch pod is equal to the span of the distance between the center axis of the prism structure of the first jib and the center axis of the prism structure of the second jib such that the second jib will insert into the second latch pod simultaneously with the insertion of the first jib into the second latch pod;

wherein the span of the distance between the center axis of the prism structure third latch pod and the center axis of the prism structure of the fourth latch pod is equal to the span of the distance between the center axis of the prism structure of the first jib and the center axis of the prism structure of the second jib such that the second jib will insert into the fourth latch pod simultaneously with the insertion of the first jib into the fourth latch pod.

14. The roofing safety system according to claim 13 wherein the square tube is a prism-shaped structure;

wherein the square tube is a rigid structure;

wherein the square tube has the tubular shape;

wherein the first anchor plate and the second anchor plate attach the square tube to the superior brink of the pitched roof such that the center axis of the prism structure of the square tube is parallel to the edge formed by the superior brink;

wherein each of the plurality of anchor rails is a rigid structure;

wherein each of the plurality of anchor rails is a u-shaped structure.

15. The roofing safety system according to claim 14 wherein the plurality of anchor rails further comprises a first anchor rail and a second anchor rail;

wherein the first anchor rail is a rigid structure;

wherein the first anchor rail is a u-shaped structure;

wherein the free end of each arm of the u-shaped structure of the first anchor rail attaches to a lateral face of the prism structure of the square tube that is adjacent to the first brink to which the first piano hinge attaches;

wherein the second anchor rail is a rigid structure;

wherein the second anchor rail is a u-shaped structure;

wherein the free end of each arm of the u-shaped structure of the second anchor rail attaches to a lateral face of the prism structure of the square tube that is adjacent to the second brink to which the second piano hinge attaches;

wherein the second anchor rail attaches to the lateral face of the prism structure of the square tube that is distal from the lateral face to which the first anchor rail attaches.

16. The roofing safety system according to claim 15 wherein the plurality of piano hinges further comprises a first piano hinge and a second piano hinge;

wherein the first piano hinge is a hinge that attaches the first anchor plate of the plurality of anchor plates to a first brink of the lateral face of the prism structure of the square tube of the master spar;

wherein the first piano hinge attaches the first anchor plate to the square tube such that the first anchor plate rotates relative to the square tube;

wherein the rotation of the first piano hinge allows the position of the first anchor plate relative to the square tube to adjust to accommodate variations in the pitch angle between different pitched roof;

wherein the second piano hinge is a hinge that attaches the second anchor plate of the plurality of anchor plates to a second brink of the lateral face of the prism structure of the square tube of the master spar;

wherein the second brink is a brink formed in the lateral face of the square tube that is adjacent to the first brink;

wherein the second piano hinge attaches the second anchor plate to the square tube such that the second anchor plate rotates relative to the square tube;

wherein the rotation of the second piano hinge allows the position of the second anchor plate relative to the square tube to adjust to accommodate variations in the pitch angle between different pitched roof.

17. The roofing safety system according to claim 16 wherein the angle iron is a rigid structure;

wherein the angle iron forms a hook like structure that forms a barrier that prevents the plurality of shingles from sliding down the pitched roof;

wherein each of the plurality of jibs is a prism-shaped structure;

wherein the plurality of jibs is a rigid structure;

wherein each of the plurality of jibs are identical;

wherein each of the plurality of jibs attaches to the angle iron in the manner of a cantilever;

wherein the free end of each of the plurality of jibs removably attaches to an anchor plate selected from the plurality of anchor plates;

wherein the plurality of jibs attach to the angle iron to form a u-shaped structure;

wherein the plurality of jibs combine to form an extension structure that separates the angle iron from the selected anchor plate to which the plurality of jibs attach;

wherein the plurality of jibs separates the angle iron from the selected anchor plate such that the plurality of shingles will fit between the plurality of jibs and the selected anchor plate.

18. The roofing safety system according to claim 17 wherein the plurality of jibs comprises a first jib and a second jib;

wherein the first jib is a prism-shaped structure;

wherein the first jib is a rigid structure;

wherein the first jib is geometrically similar to the congruent ends of both the first latch pod and the third latch pod such that the first jib inserts into the congruent end of a latch pod selected from the group consisting of the first latch pod and the third latch pod;

wherein the first jib is an extension structure that forms and controls the reach between the master spar and the angle iron of the shingle shelf;

wherein the first jib attaches to the first latch pod by inserting the first jib into the first latch pod such that the first radial hole aligns with the fifth radial hole;

wherein the first cotter pin is then inserted simultaneously through the first radial hole and the fifth radial hole while they are aligned;

wherein the first jib attaches to the third latch pod by inserting the first jib into the third latch pod such that the third radial hole aligns with the fifth radial hole;

wherein the first cotter pin is then inserted simultaneously through the third radial hole and the fifth radial hole while they are aligned;

wherein the first jib further comprises a fifth radial hole;

wherein the fifth radial hole is a radial hole formed through the prism structure of the first jib;

wherein the inner dimension of the fifth radial hole is sized to receive the first cotter pin;

wherein the position of the fifth radial hole is such that the fifth radial hole aligns with the first radial hole when the first jib inserts into the first latch pod;

wherein the position of the fifth radial hole is such that the fifth radial hole aligns with the third radial hole when the first jib inserts into the third latch pod;

wherein the second jib is a prism-shaped structure;

wherein the second jib is a rigid structure;

wherein the second jib is geometrically similar to the congruent ends of both the second latch pod and the fourth latch pod such that the second jib inserts into the congruent end of a latch pod selected from the group consisting of the second latch pod and the fourth latch pod;

wherein the second jib is an extension structure that forms and controls the reach between the master spar and the angle iron of the shingle shelf;

wherein the second jib attaches to the second latch pod by inserting the second jib into the second latch pod such that the second radial hole aligns with the sixth radial hole;

wherein the second cotter pin is then inserted simultaneously through the second radial hole and the sixth radial hole while they are aligned;

wherein the second jib attaches to the fourth latch pod by inserting the second jib into the fourth latch pod such that the fourth radial hole aligns with the sixth radial hole;

wherein the second cotter pin is then inserted simultaneously through the fourth radial hole and the sixth radial hole while they are aligned;

wherein the second jib further comprises a sixth radial hole;

wherein the sixth radial hole is a radial hole formed through the prism structure of the second jib;

wherein the inner dimension of the sixth radial hole is sized to receive the second cotter pin;

wherein the position of the sixth radial hole is such that the sixth radial hole aligns with the second radial hole when the second jib inserts into the second latch pod;

wherein the position of the sixth radial hole is such that the sixth radial hole aligns with the fourth radial hole when the second jib inserts into the fourth latch pod.

19. The roofing safety system according to claim 18 wherein the first cotter pin is a prism-shaped structure;

wherein the first cotter pin is a rigid structure;

wherein the first cotter pin forms an attachment selected from the group consisting of: a) attaching the first jib to the first latch pod of the first anchor plate; and, b) attaching the first jib to the third latch pod of the second anchor plate;

wherein the second cotter pin is a prism-shaped structure;

wherein the second cotter pin is a rigid structure;

wherein the second cotter pin forms an attachment selected from the group consisting of: a) attaching the second jib to the second latch pod of the first anchor plate; and, b) attaching the second jib to the fourth latch pod of the second anchor plate;

wherein the first cotter pin simultaneously inserts through both the first radial hole of the first anchor plate and the fifth radial hole of the first jib to attach the first jib to the first latch pod;

wherein the first cotter pin simultaneously inserts through both the third radial hole of the second anchor plate and the fifth radial hole of the first jib to attach the first jib to the third latch pod;

wherein the second cotter pin simultaneously inserts through both the second radial hole of the first anchor plate and the sixth radial hole of the second jib to attach the second jib to the second latch pod;

wherein the second cotter pin simultaneously inserts through both the fourth radial hole of the second anchor plate and the sixth radial hole of the second jib to attach the second jib to the fourth latch pod.

* * * * *